US007722414B2

(12) United States Patent
Tanaka et al.

(10) Patent No.: US 7,722,414 B2
(45) Date of Patent: May 25, 2010

(54) CONNECTOR HAVING SEPARATELY MADE LANCE HOUSING AND RETAINER

(75) Inventors: Tsutomu Tanaka, Yokkaichi (JP); Tsuyoshi Mase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/360,445

(22) Filed: Jan. 27, 2009

(65) Prior Publication Data

US 2009/0191747 A1 Jul. 30, 2009

(30) Foreign Application Priority Data

Jan. 29, 2008 (JP) ..... 2008-017578

(51) Int. Cl.
*H01R 13/514* (2006.01)

(52) U.S. Cl. ..... 439/757; 439/595

(58) Field of Classification Search ..... 439/752, 439/752.5, 352, 598, 595
See application file for complete search history.

(56) References Cited

U.S. PATENT DOCUMENTS 6,575,788 B2 * 6/2003 Nimura et al. ..... 439/595
6,626,702 B2 * 9/2003 Kurimoto et al. ..... 439/595
6,638,109 B2 * 10/2003 Kurimoto et al. ..... 439/595
2008/0280489 A1 * 11/2008 Tanaka et al. ..... 439/598
2008/0293281 A1 * 11/2008 Tanaka et al. ..... 439/295
2009/0191749 A1 * 7/2009 Mase et al. ..... 439/397
2009/0191754 A1 * 7/2009 Mase et al. ..... 439/598

FOREIGN PATENT DOCUMENTS

JP 9-161875 6/1997

* cited by examiner

*Primary Examiner*—Hae Moon Hyeon
(74) *Attorney, Agent, or Firm*—Gerald E. Hespos; Michael J. Porco

(57) ABSTRACT

In a male connector (10), a lance housing (50) including locking lances (27) is provided separately from a housing main body (20) and a retainer including terminal locking portions (78) to be located in deformation spaces (63) for the locking lances (27) in a properly assembled state is provided separately from the lance housing (50). A projection (75) projects backward from the retainer (70), and a receiving hole (69) for receiving the projection (75) is formed in the front surface of the lance housing (50) to penetrate the lance housing (50). The lance housing (50) is positioned with respect to the retainer (70) by inserting the projection (75) into the receiving hole (69).

7 Claims, 18 Drawing Sheets

CONNECTOR HAVING SEPARATELY MADE LANCE HOUSING AND RETAINER

BACKGROUND OF THE INVENTION

1. Field of the Invention

The invention relates to a connector.

2. Description of the Related Art

Japanese Unexamined Patent Publication No. H09-161875 discloses a connector that has a housing formed with cavities for receiving terminal fittings. Resiliently deformable locking lances project at inner surfaces of the cavities for locking the terminal fittings in the cavities. A retainer is arranged on the front surface of the housing and has terminal locks that fit into deformation spaces for the locking lances. The terminal locks of the retainer restrict resilient deformations of the locking lances to achieve double locking of the terminal fittings. A guide projects from the front surface of the housing and a fitting portion penetrates the retainer. The guide is inserted into the fitting portion as the retainer is assembled.

Resin flowability decreases during molding a housing for a multipolar connector. Therefore it is difficult to mold a unitary housing that has small locking lances and the like.

The invention was developed in view of the above situation and an object thereof is to allow a connector to have an improved moldability while having a good operability.

SUMMARY OF THE INVENTION

The invention relates to a connector with a housing main body formed with one or more cavities for receiving terminal fittings. At least one lance housing is provided separately from the housing main body and is formed with one or more terminal insertion holes that communicate with the respective cavities when the lance housing is arranged on the housing main body. The lance housing has one or more resiliently deformable locking lances that correspond to the terminal insertion holes. The locking lances retain the terminal fittings inserted into the terminal insertion holes. A retainer is provided separately from the lance housing and includes one or more terminal locks that can enter deformation spaces for the respective locking lances engaged with the terminal fittings when the retainer is arranged on the lance housing.

At least one projection preferably projects from the retainer and at least one receiving hole is formed in the lance housing for receiving the projection. The lance housing and the retainer are positioned with respect to each other by inserting the projection into the respective receiving hole.

The projection preferably projects backward from the retainer and the receiving hole preferably is formed in the front surface of the lance housing. Thus, a positional relationship of the lance housing and the retainer is determined precisely and the retaining function of the retainer is exhibited correctly. Additionally, the leading end of the projection can be fit into the insertion hole as the retainer is assembled.

The engagement of the projection with the lance housing and the housing main body suppresses shaking movements of the retainer and ensures proper positioning of the retainer, the lance housing and the housing main body.

The retainer preferably is displaceable between a partly locked state and a fully locked state. The locking lances are permitted to deform when the retainer is in the partly locked state so that the terminal fittings can be inserted into the cavities and withdrawn from the cavities. The locking lances cannot deform when the retainer is in the fully locked state so that the properly inserted terminal fittings are locked redundantly in the cavities.

The leading end of the projection preferably is fit in the insertion hole when the retainer is both in the partly locked state and in the fully locked state.

The retainer is stable without shaking not only in the fully locked state, but also in the partly locked state. When the retainer moves from the partly locked state to the fully locked state, the projection is smoothly inserted into the insertion hole without getting caught by the hole edge of the insertion hole.

The projection preferably includes at least a first part extending in a first direction and at least a second part extending in a second direction intersecting the first direction. At least one rib is provided at a position back to back with the projection, with a main body of the retainer located therebetween.

The first direction preferably is a height direction and the second direction preferably is a width direction.

The projection preferably has a cross-shaped cross section and is at or near a central part of the rear surface of the retainer. Thus, a reduction in the effective space of the retainer can be suppressed to a minimum necessary level as compared with the case where the projection is provided over a wide range of the rear surface of the retainer. Further, the cross-shaped cross section ensures sufficient strength for the projection, while also suppressing shaking movements in the height and width directions and hindering pivotal movements of the lance housing about an axis of the projection.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
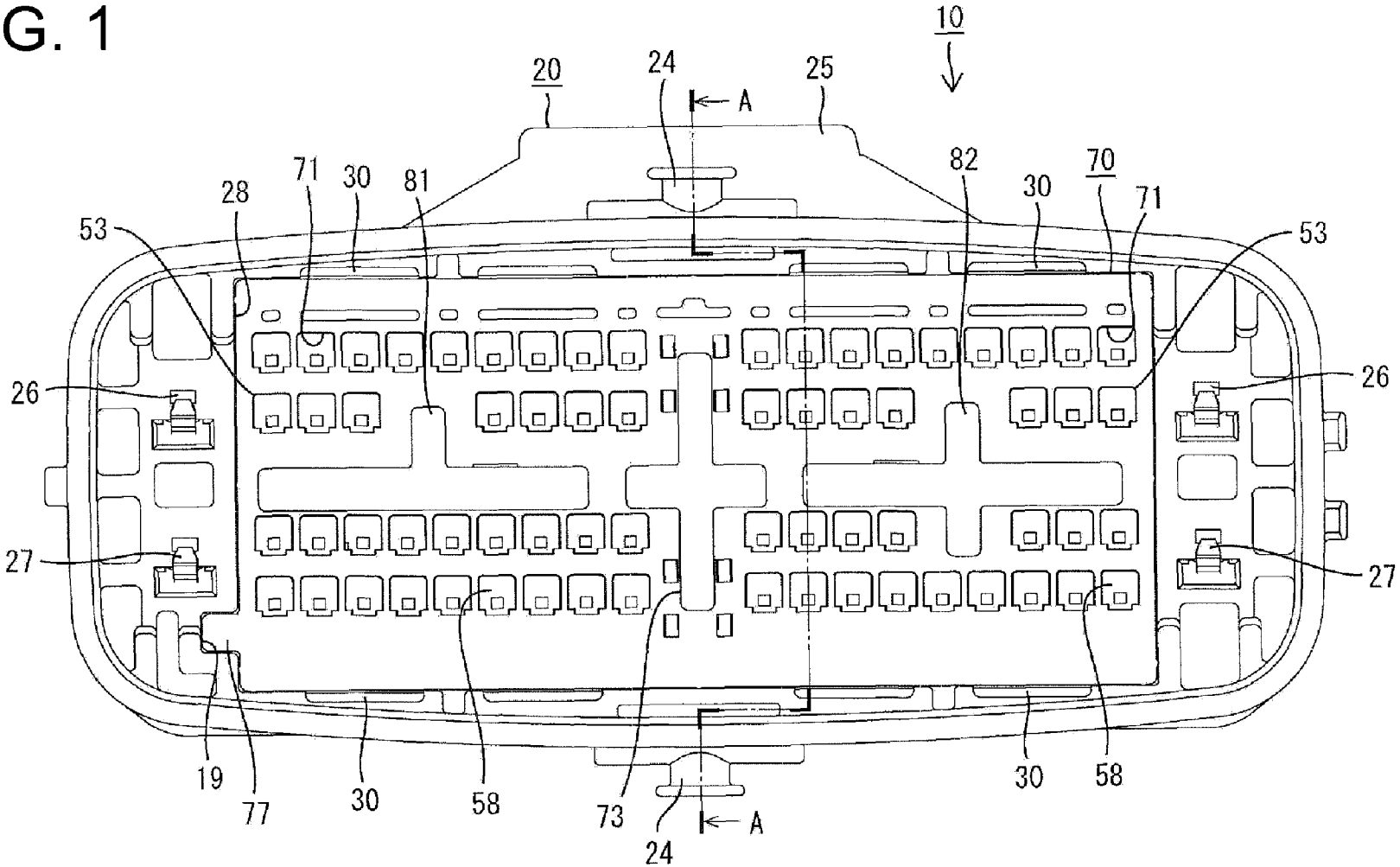
FIG. 1 is a front view of one embodiment of the invention when a lance housing and a retainer are assembled with a housing main body.

A male connector in accordance with the invention is illustrated in FIGS. 1 to 17 and is identified generally by the numeral 10. The connector 10 connectable with a mating female connector 100 and is provided with a housing main body 20, a lance housing 50, a retainer 70 and male terminal fittings 90. The housing main body 20, the lance housing 50 and the retainer 70 are made e.g. of a synthetic resin or different synthetic resins and the male terminal fittings 90 are made of an electrically conductive material such as metal. In the following description, an end to be connected with the mating female connector 100 is referred to as the front end concerning forward and backward directions FBD and reference is made to FIG. 1 concerning vertical direction.

Figure 2:
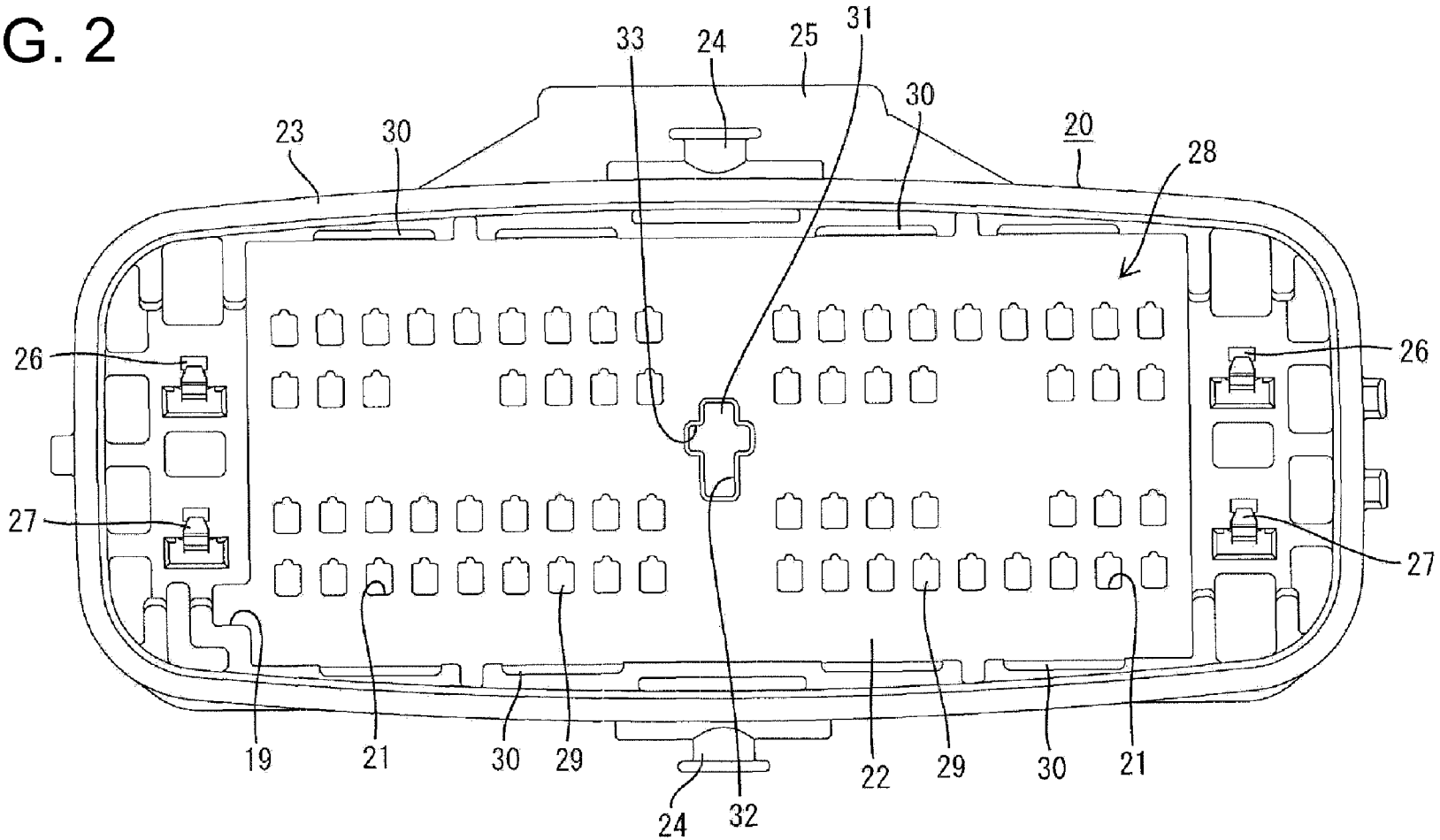
FIG. 2 is a front view of the housing main body.
Figure 7:
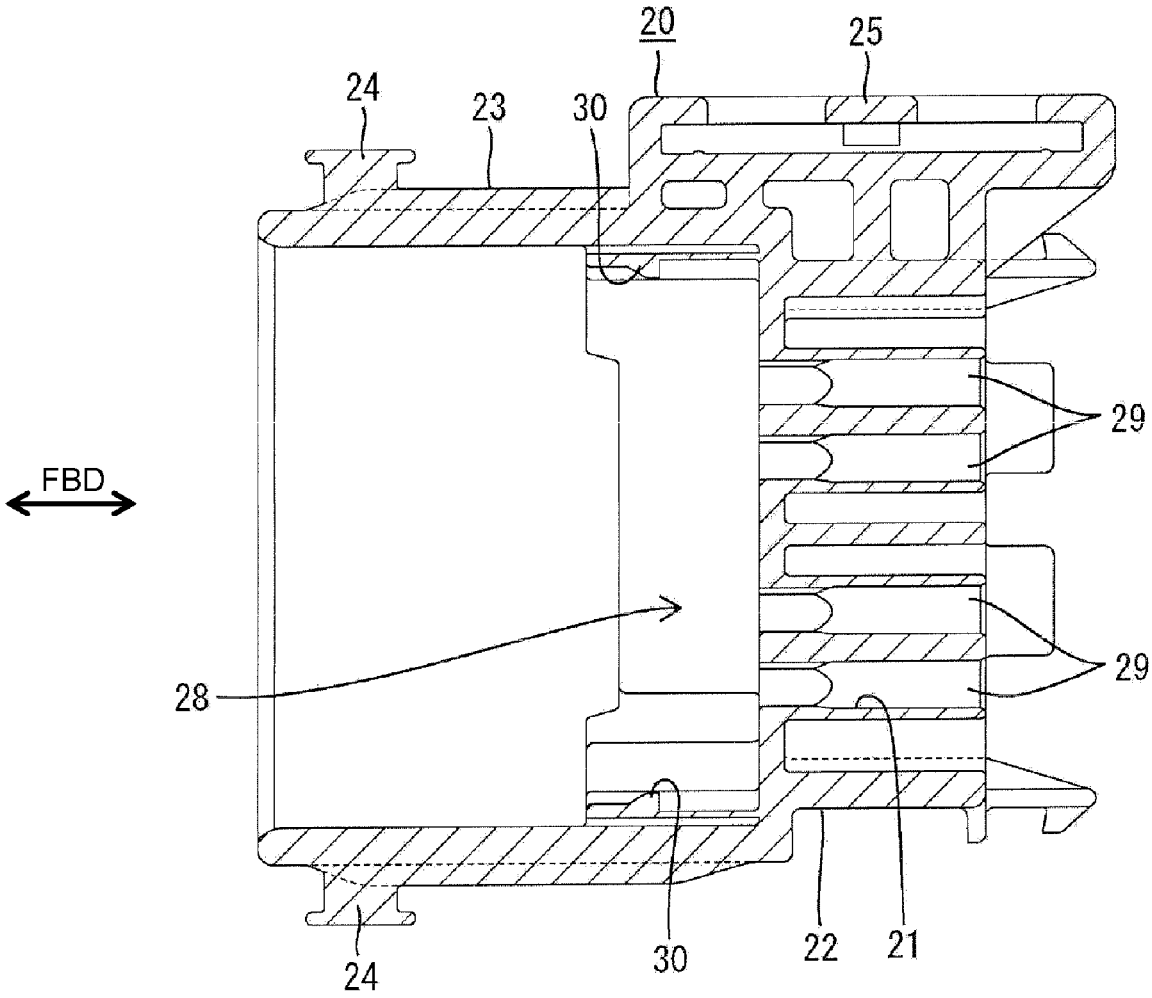
FIG. 7 is a side view in section of the housing main body.
Figure 8:
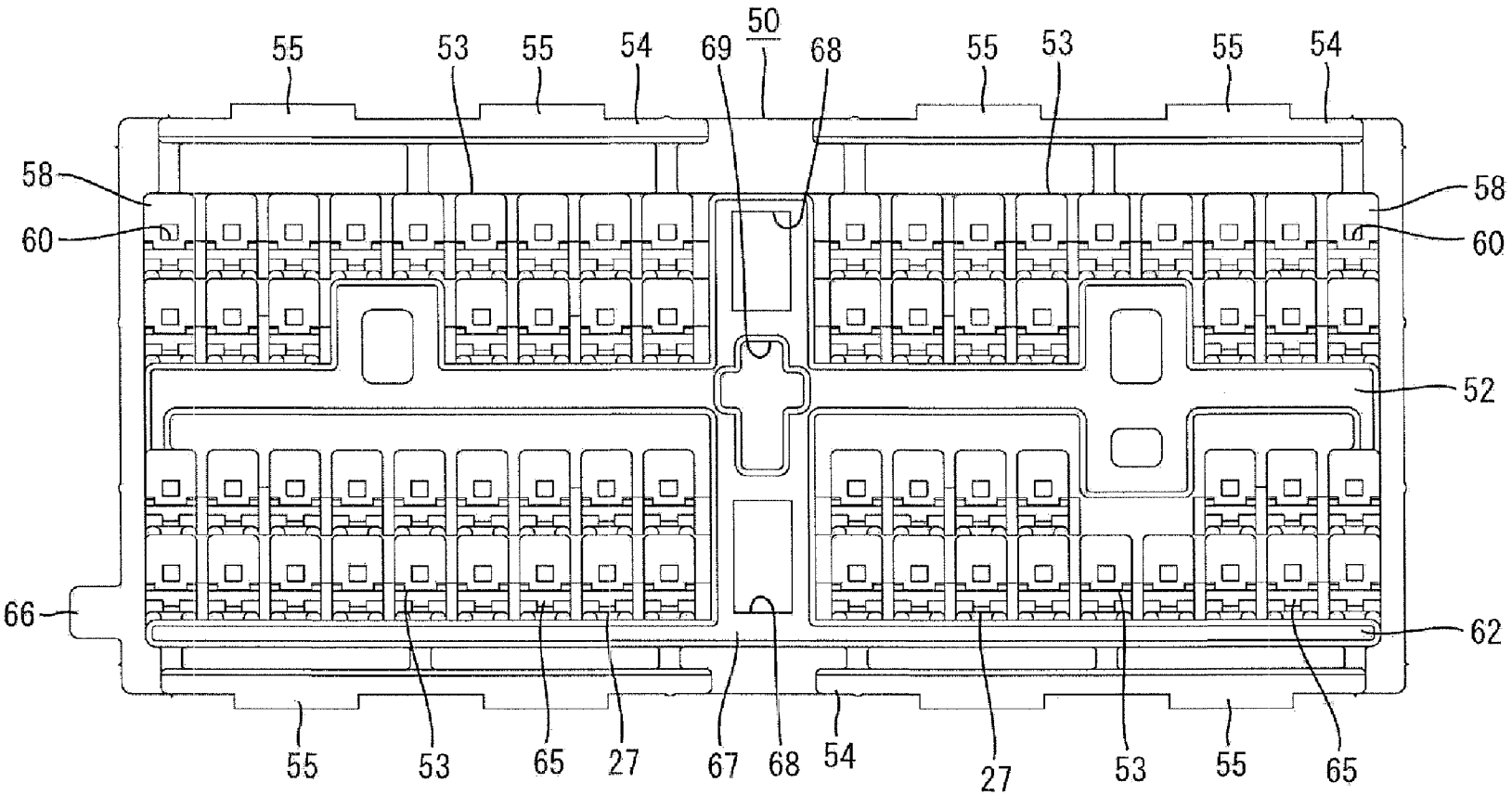
FIG. 8 is a front view of the lance housing.
Figure 9:
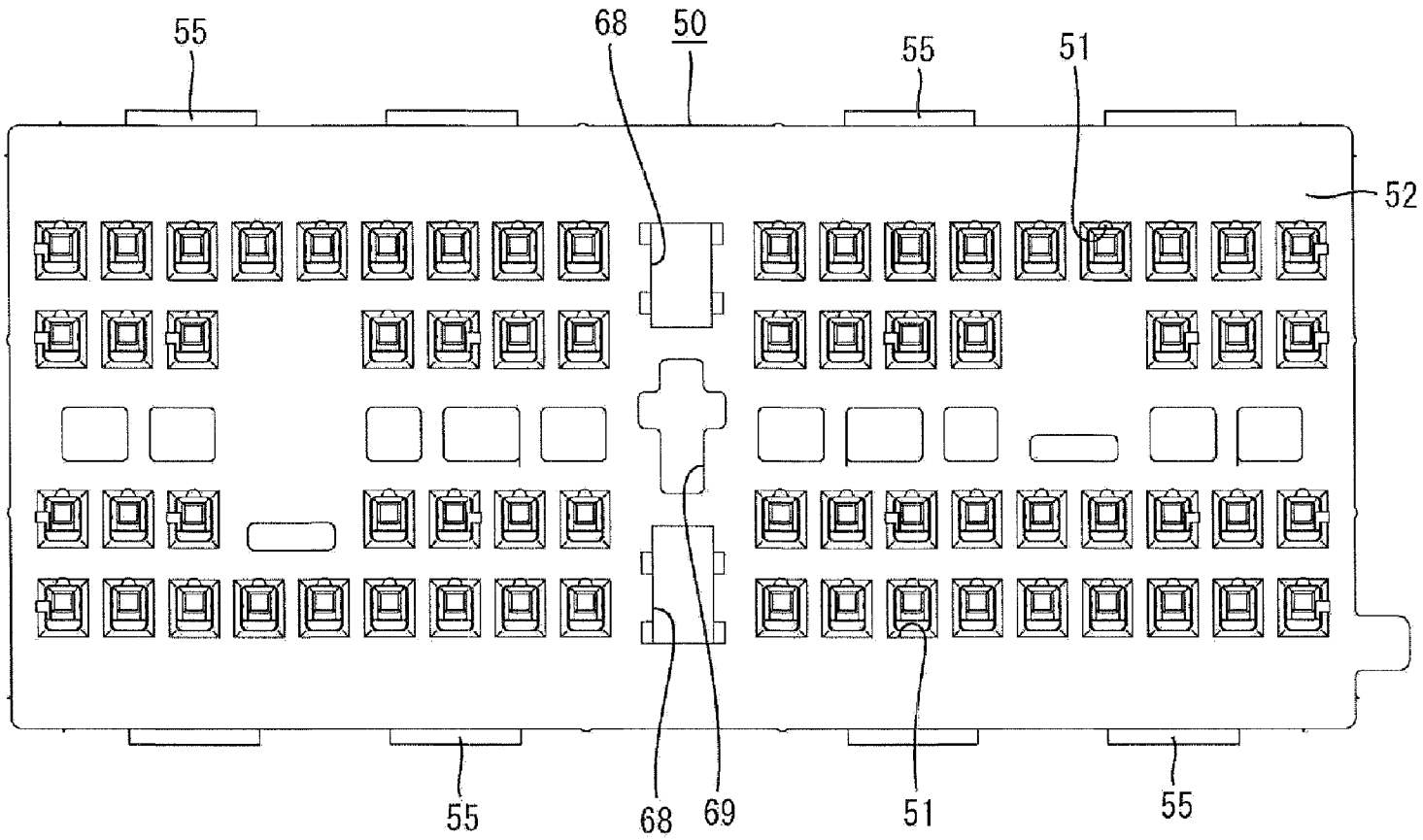
FIG. 9 is a rear view of the lance housing.
Figure 10:
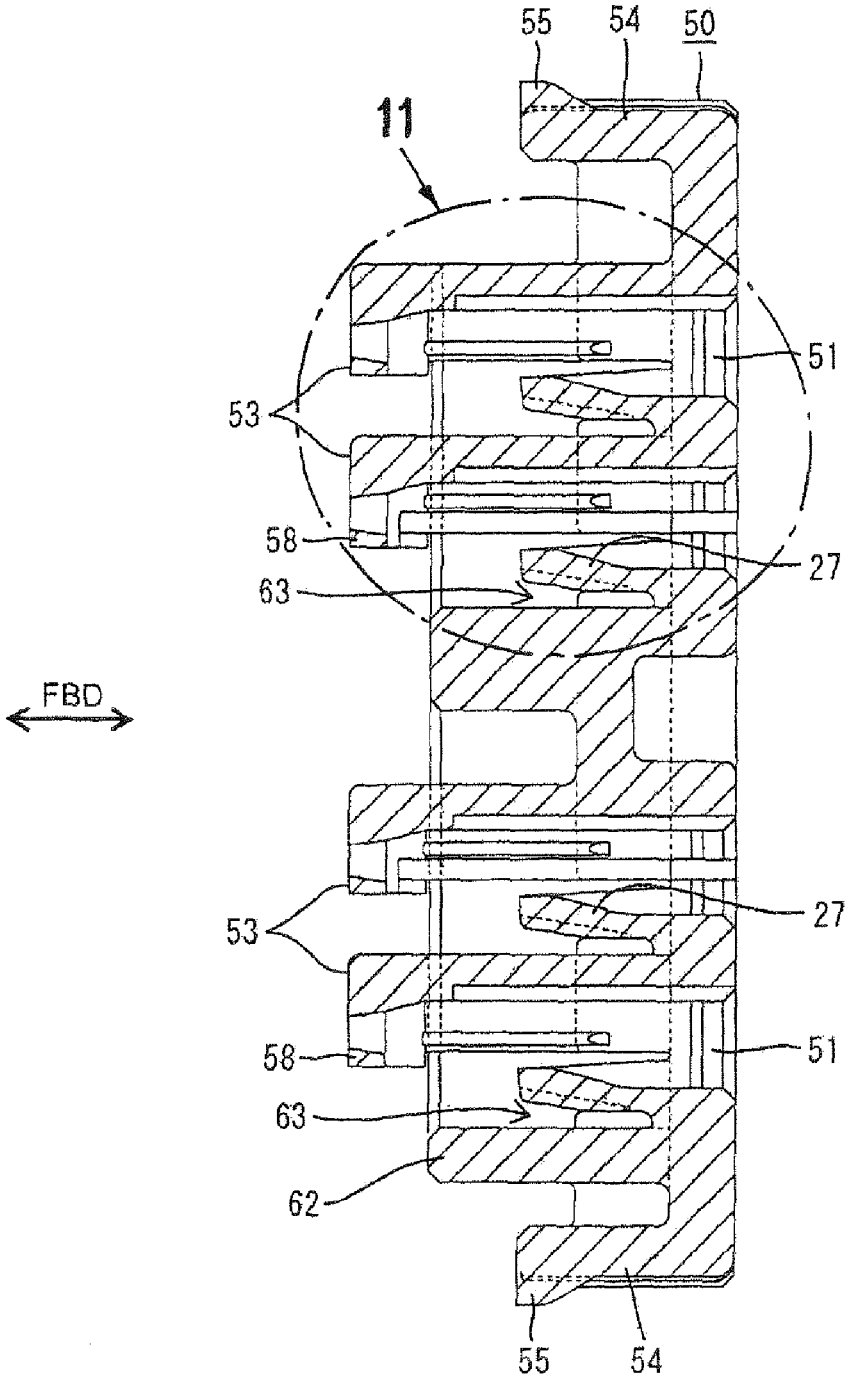
FIG. 10 is a side view in section of the lance housing.
Figure 11:
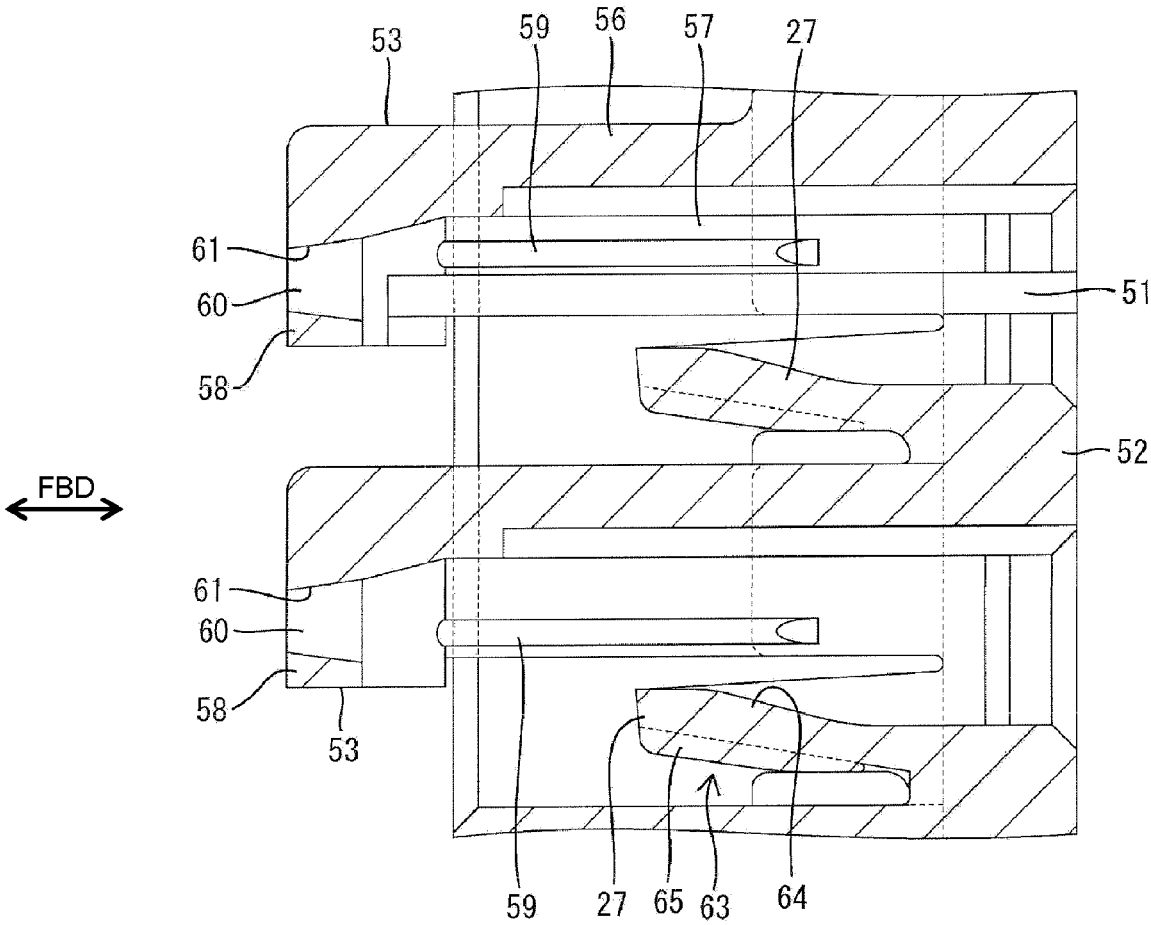
FIG. 11 is an enlarged view showing an essential part of FIG. 10.
Figure 12:
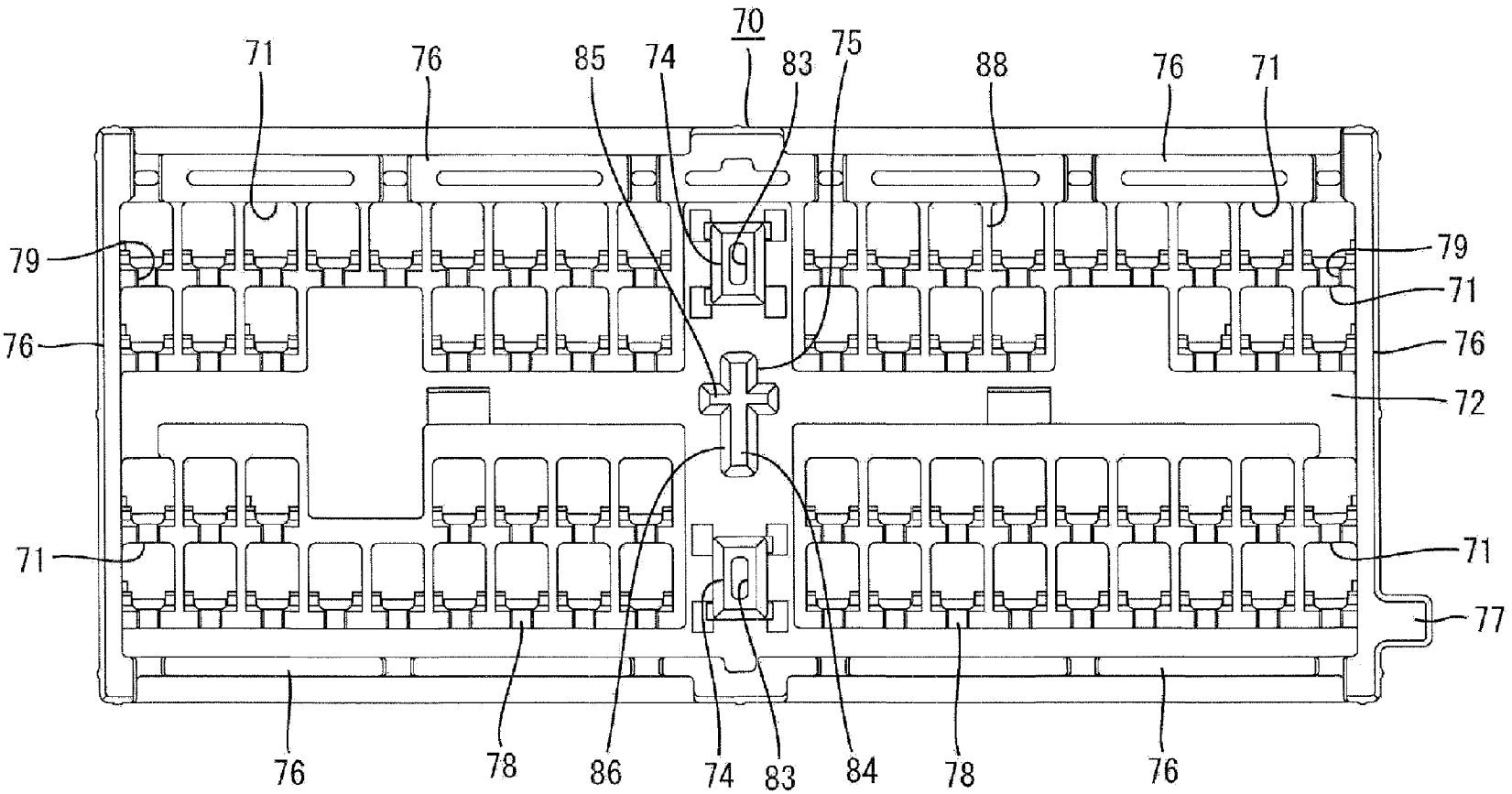
FIG. 12 is a rear view of the retainer.
Figure 13:
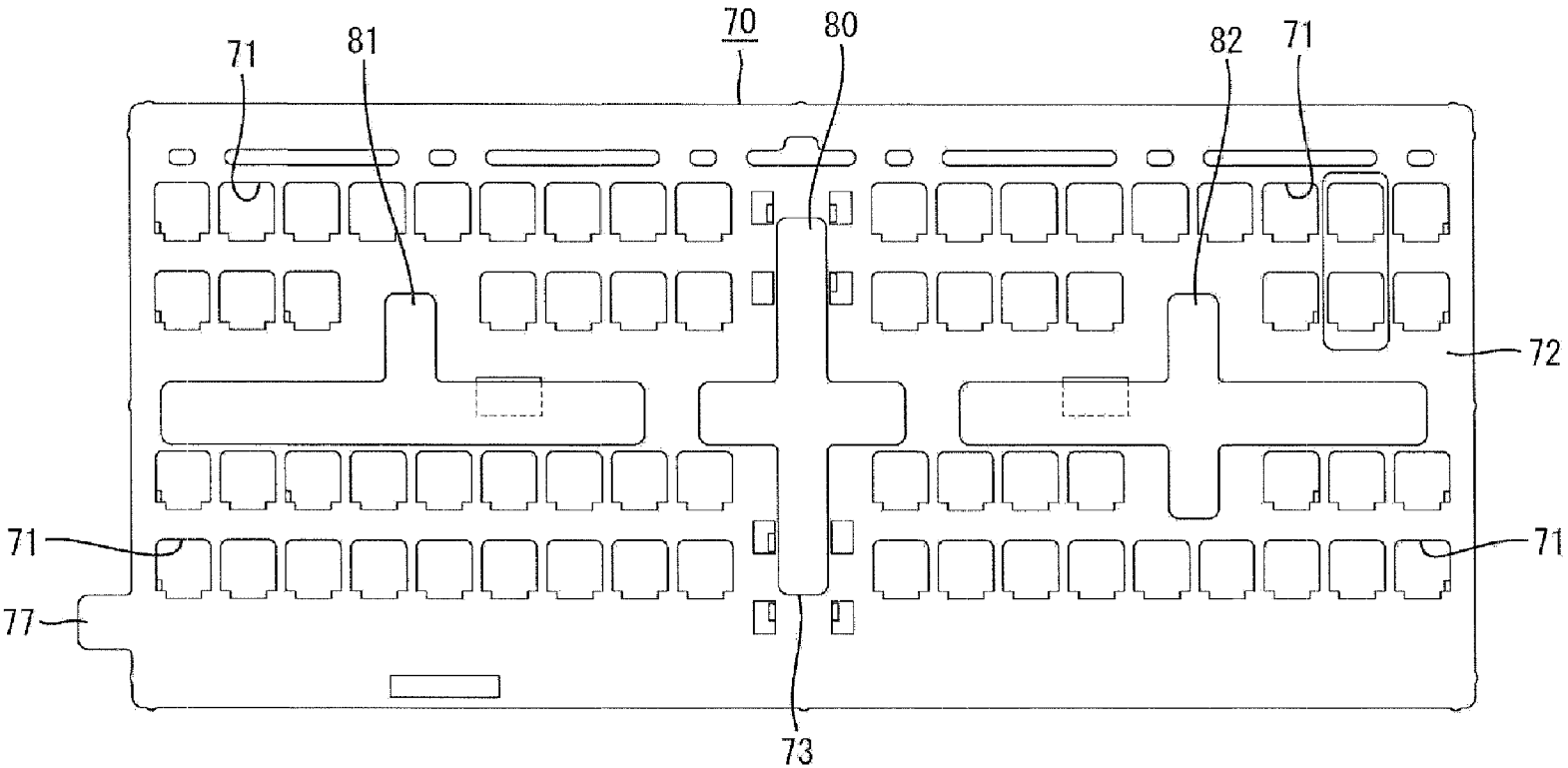
FIG. 13 is a front view of the retainer.
Figure 14:
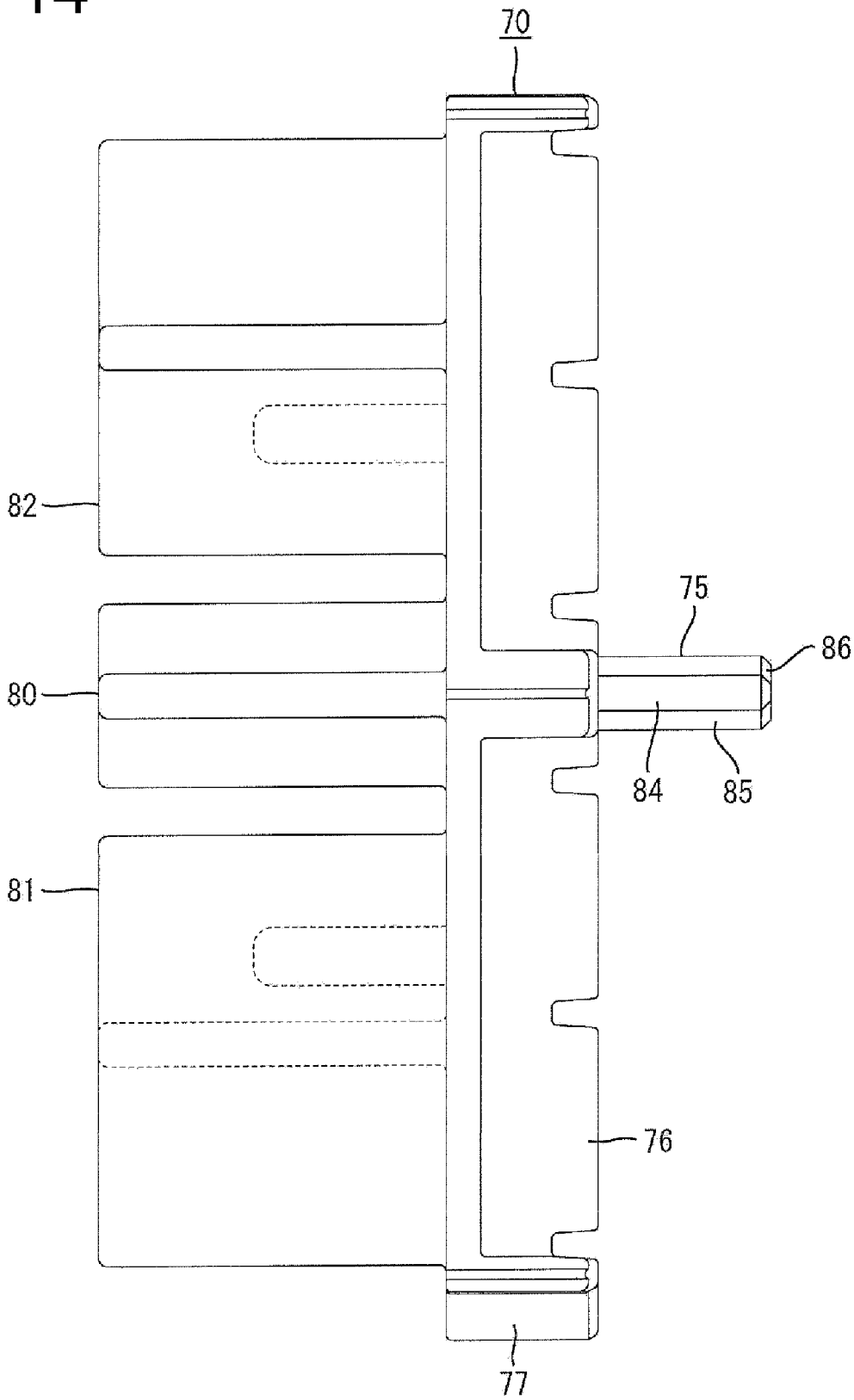
FIG. 14 is a bottom view of the retainer.
Figure 15:
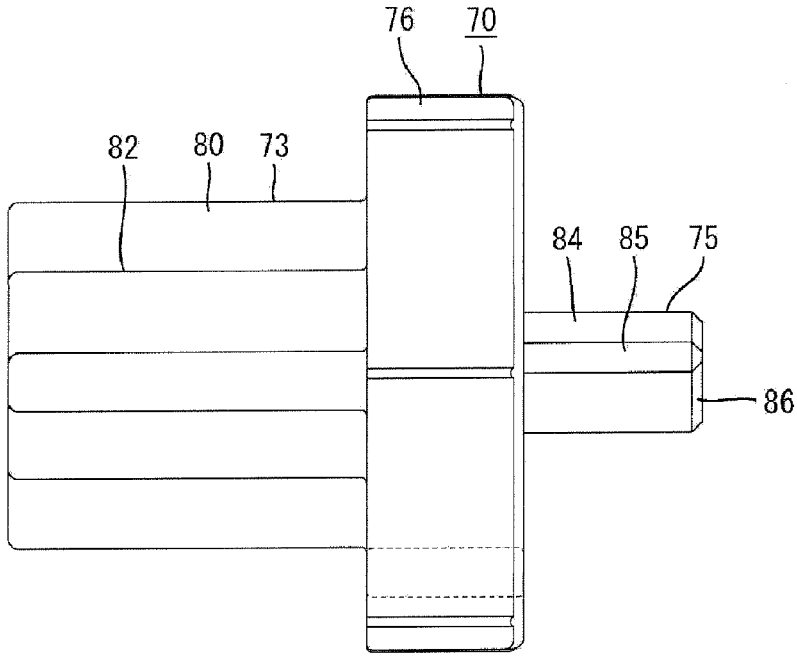
FIG. 15 is a side view of the retainer.
Figure 16:
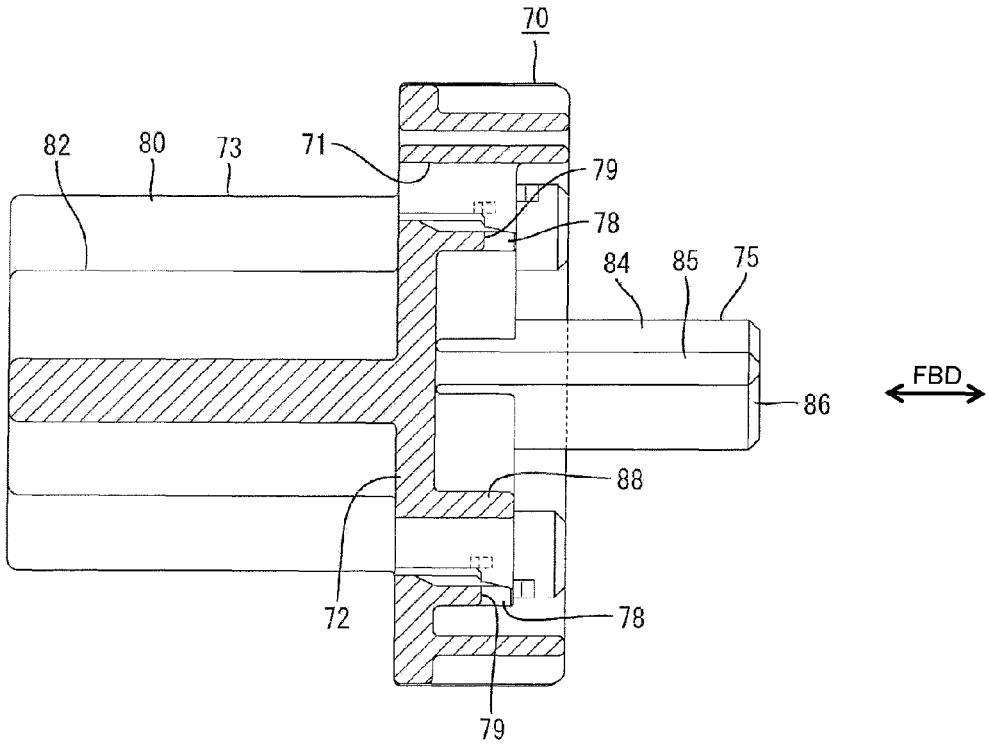
FIG. 16 is a side view in section of the retainer.

The housing main body 20 cooperates with the lance housing 50 to form a connector housing and includes a terminal accommodating portion 22 formed with cavities 21 for accommodating the respective male terminal fittings 90 and a wide tubular receptacle 23 projects forward from the peripheral edge of the front surface of the terminal accommodating portion 22 as shown in FIGS. 2 and 7. Tabs 91 of the respective male terminal fittings 90 are arranged to project into the receptacle 23, and upper and lower cam followers 24 project from the outer surfaces of the opposite upper and lower walls of the receptacle 23 for exhibiting a cam action by a connecting operation with the mating female connector 100. A stay lock 25 projects behind the upper cam follower 24 in a widthwise central part of the housing main body 20 and is engageable with an unillustrated bracket.

Two large cavities 26 are provided at each of the opposite widthwise sides of the terminal accommodating portion 22 for accommodating large male terminal fittings 90. The large cavities 26 in each pair are arranged one above the other in a vertical direction and vertically resiliently deformable locking lances 27 project at the front ends of the inner surfaces of the large cavities 26.

The front surface of a widthwise intermediate part of the terminal accommodating portion 22 is retracted slightly back from the front surfaces of the large cavities 26 located in the widthwise end parts. Thus, a mount space 28 for the lance housing 50 is formed between the opposite inner surfaces of the widthwise end parts and has a substantially having a rectangular shape when viewed from the front. Small cavities 29 are arrayed in vertical and width directions in the widthwise intermediate part of the terminal accommodating portion 22 for accommodating small male terminal fittings 90. The small cavities 29 are arranged in upper and lower levels at each of the opposite sides of a vertical central part. No locking lances 27 are formed at inner surfaces of the small cavities 29.

Claw-shaped lance housing locks 30 project on the inner surfaces of opposite upper and lower walls of the mount space 28 of the terminal accommodating portion 22 for retaining the lance housing 50. A bottomed insertion hole 31 is formed in the front surface of a widthwise intermediate part of the terminal accommodating portion 22 at a position corresponding to a intermediate part of the housing main body 20 in the width and vertical directions. The insertion hole 31 is substantially cross-shaped in a front view and is comprised of a long vertical groove 32 and a short horizontal groove 33. The vertical and horizontal grooves 32, 33 cross at right angles at a position slightly above the vertical center and communicate with each other. It should be understood that the insertion hole 31 may have a different configuration (e.g. the grooves 32, 33 may cross at a different angle) and may be oriented differently (e.g. the insertion hole 31 may be rotated around its axis).

Figure 3:
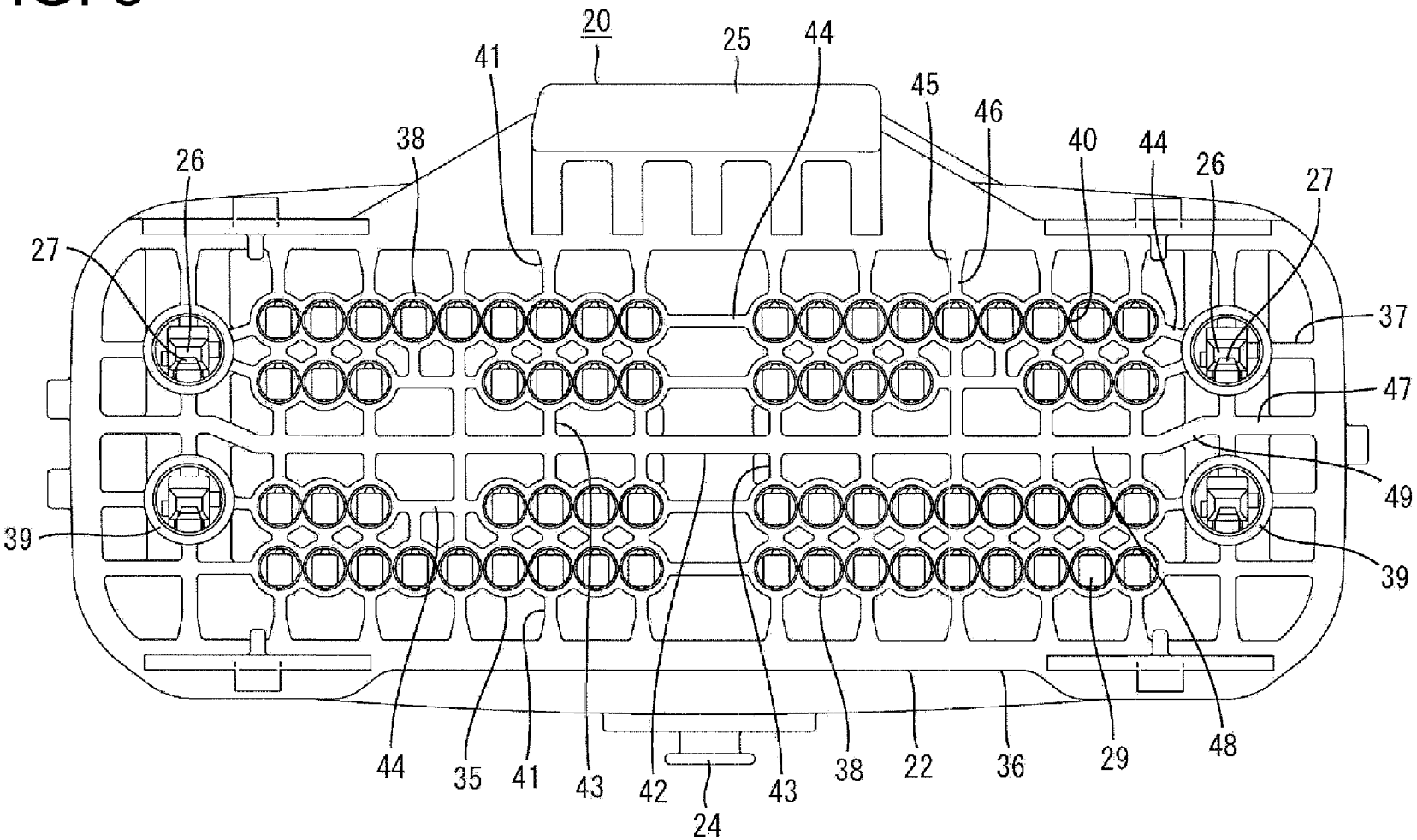
FIG. 3 is a rear view of the housing main body.
Figure 4:
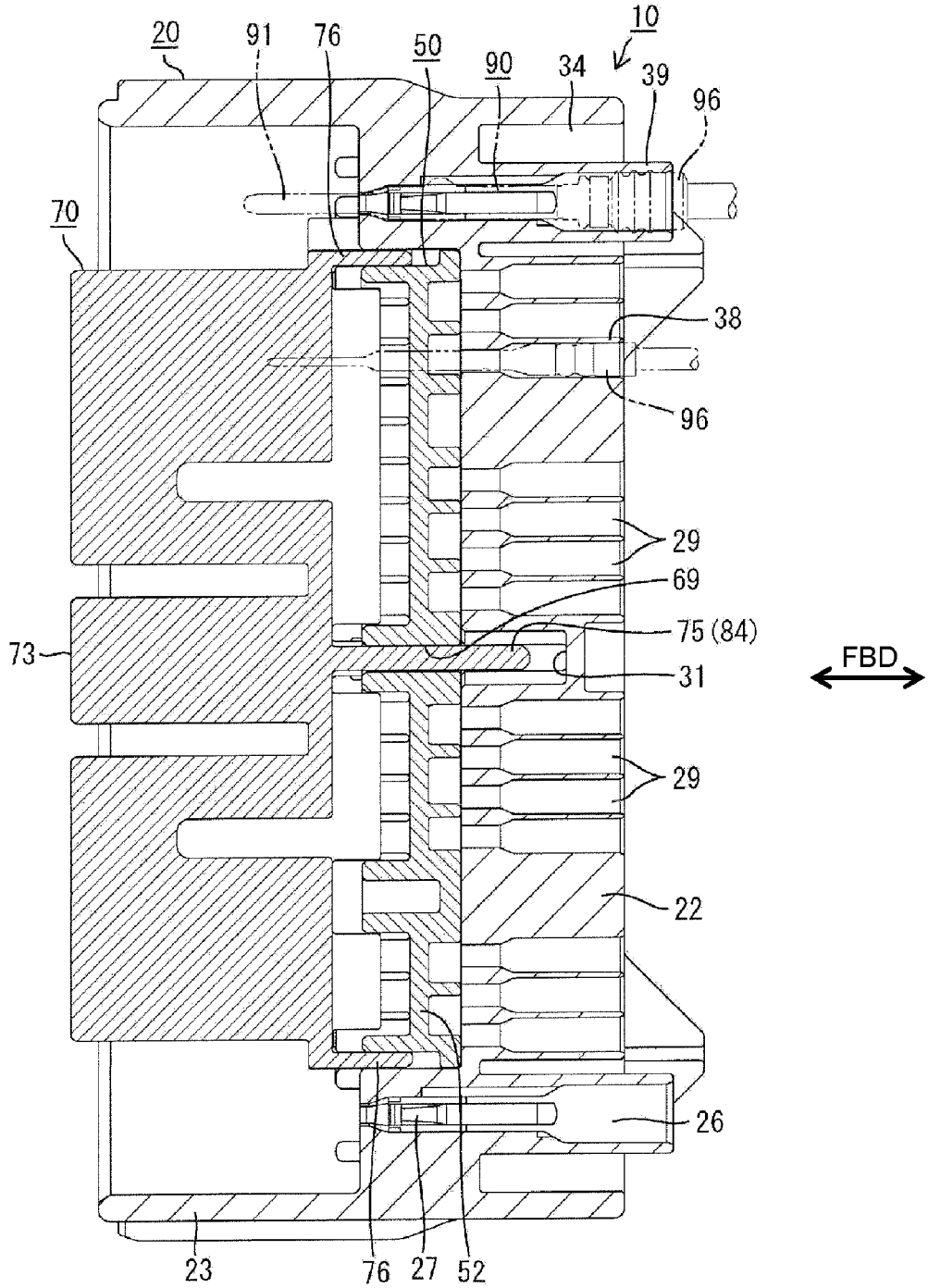
FIG. 4 is a horizontal section when the retainer is assembled with the housing main body and the lance housing.

As shown in FIGS. 3 and 4, bores 34 are provided at a rear part of the terminal accommodating portion 22 for preventing the formation of sinks. Right cylindrical seal towers 35 project back by the bores 34. The seal towers 35 are at positions corresponding to the respective cavities 21 and are circular enclosures surrounding the cavities 21. A sealing plug 96 is fit on an end of a wire 95 connected with the male terminal fitting 90 and seals to the inner circumferential surface of each seal tower 35. Thus, the insides of the seal towers 35 and the inside of the housing main body 20 are sealed hermetically.

A wide tubular surrounding wall 36 is provided on a rear part of the housing main body 20 and surrounds the seal towers 35. Ribs 37 are provided inside this surrounding wall 36. The surrounding wall 36 forms the outer wall of the housing main body 20 and is open backward toward a side opposite to the receptacle 23.

The seal towers 35 include small seal towers 38 corresponding to the small cavities 29 and large seal towers 39 corresponding to the large cavities 26. The small seal towers 38 are at positions corresponding to the small cavities 29 in the widthwise intermediate middle part. Thus, the small seal towers 38 are arranged in upper and lower levels at each of the opposite sides of a vertical central part and at the opposite left and right sides of a widthwise central part. Two large seal towers 39 are arranged one above the other near each of the opposite widthwise end sides. Some of the small seal towers 38 are united unitarily in the width direction via common thin walls 40. The centers of the upper large seal towers 39 substantially align with a plane between the two upper levels of small seal towers 38. On the other hand, the vertical centers of the lower larger seal towers 39 are above a plane between the two lower levels of small seal towers 38.

The length of the small seal towers 38 in forward and backward directions FBD substantially equals the length of the surrounding wall 36 and the ribs 37. The front and rear ends of the small seal towers 38 are aligned substantially at the same positions as the front and rear ends of the surrounding wall 36 and the ribs 37 and the rear surfaces of the small seal towers 38 form the rear surface of the housing main body 20 together with those of the surrounding wall 36 and the ribs 37. On the other hand, the front ends of the large seal towers 39 are at substantially the same positions as the front ends of the small seal towers 38, but the rear ends thereof are more backward than rear ends of the small seal towers 38. The small seal towers 38 are thinner than the large seal towers 39 and also are thinner than the surrounding wall 36 and the minimum dimension of the ribs 37.

The ribs 37 extend between the inner surfaces of the surrounding wall 36 like a lattice and include the outer ribs 41, a main rib 42, inner ribs 43 and connecting ribs 44. The outer ribs 41 extend between the inner surfaces of the surrounding wall 36 and the outer surfaces of the seal towers 35. The main rib 42 extends between the opposite inner side surfaces of the surrounding wall 36 and crosses the vertical central part of the surrounding wall 36 in the width direction. The inner ribs 43 extend between the main rib 42 and the outer surfaces of the seal towers 35 and the connecting ribs 44 connecting the adjacent seal towers 35.

Each outer rib 41 is thick at the connection with the surrounding wall 36 and thin at its connection with the seal tower 35. More specifically, each outer rib 41 has a tapered section 45 gradually narrowed toward the seal tower 35 from the connection with the surrounding wall 36. A straight section 46 extends straight from the leading end of the tapered section 45 to the seal tower 35. Thus, the opposite side surfaces of the tapered section 45 and those of the straight section 46 are at obtuse angles to each other. The outer ribs 41 extend vertically between opposite upper and lower walls of the surrounding wall 36 and the seal towers 35 facing these walls and are outward (directions orthogonal to tangents) of the seal towers 35 while being spaced apart at specified intervals in the width direction. The maximum thickness of the outer ribs 41 where the tapered sections 45 connected with the surrounding wall 36 exceeds thicknesses of the other ribs 42, 43, and 44. The minimum thickness of the outer ribs 41 on the straight sections 46 is substantially equal to thicknesses of the inner ribs 43 and the connecting ribs 44.

The main rib 42 is comprised of first main ribs 47 arranged to cross substantially straight in the width direction between the upper and lower large seal towers 39 from the opposite inner side surfaces of the surrounding wall 36, at least one second main rib 48 crossing substantially straight in the width direction between the respective small seal towers 38 at the upper and lower stages and third main ribs 49 extending obliquely straight with a downward gradient from the first main ribs 47 to the second main rib 48. The first, second and third main ribs 47, 48 and 49 have the same thickness, which are slightly smaller than the maximum thicknesses of the outer ribs 41, but larger than the minimum thicknesses of the outer ribs 41.

One or more gates (not shown), are provided at the substantially opposite lateral outer sides of the surrounding wall 36 for receiving molten resin while molding the housing main body 20. The main rib 42 is near these gates so that the molten resin injected from the gates can flow in its injection directions.

The inner ribs 43 extend vertically between the second main rib 48 and the small seal towers 38 facing the second main rib 48 and between the first main ribs 47 and the large seal towers 39 facing the first main ribs 47. The inner ribs 43 are arranged at the same intervals as the outer ribs 41 in the width direction. The inner ribs 43 are arranged vertically symmetrically with respect to the second main rib 48 and are inward of the seal towers 35. The inner and outer ribs 43 and 41 are on substantially straight lines passing the centers of the seal towers 35. Thus, the inner and outer ribs 43 and 41 vertically cross the inside of the surrounding wall 36 via the seal towers 35 and the inner ribs 43 and the main rib 42 are connected substantially at right angles to each other.

The connecting ribs 44 extend between the adjacent seal towers 35 that are separated without being connected by the thin walls 40 and have lengths corresponding to distances between the adjacent seal towers 35. Each connecting rib 44 is located on a straight line connecting the centers of the adjacent seal towers 35 and is connected with the outer circumferential surfaces of the seal towers 35 substantially at right angles to tangent directions to these outer circumferential surfaces.

The small seal towers 38 adjacent to each other are arranged substantially side by side in the width direction and, thus, the connecting ribs 44 extending between the respective small seal towers 38 are arranged substantially horizontally in the width direction. Longer horizontal connecting ribs 44 are connected with the inner ribs 43 substantially at right angles at intermediate positions. The centers of the small seal towers 38 located at the opposite widthwise ends in the two upper levels and those of the upper large seal towers 39 are displaced vertically. Therefore the connecting ribs 44 extending between the small seal towers 38 in the two upper levels and the upper large seal towers 39 are arranged obliquely with respect to the horizontal direction. On the other hand, the connecting ribs 44 extending between those of the small seal towers 38 in the two lower levels located right below the main rib 42 and located at the opposite widthwise ends and the lower large seal towers 39 are arranged obliquely with a small upward gradient from the centers of the small seal towers 38 to the lower large seal towers 39. There are no connecting ribs 44 extending between the seal towers 38 in the bottommost level and the large seal towers 39.

Figure 17:
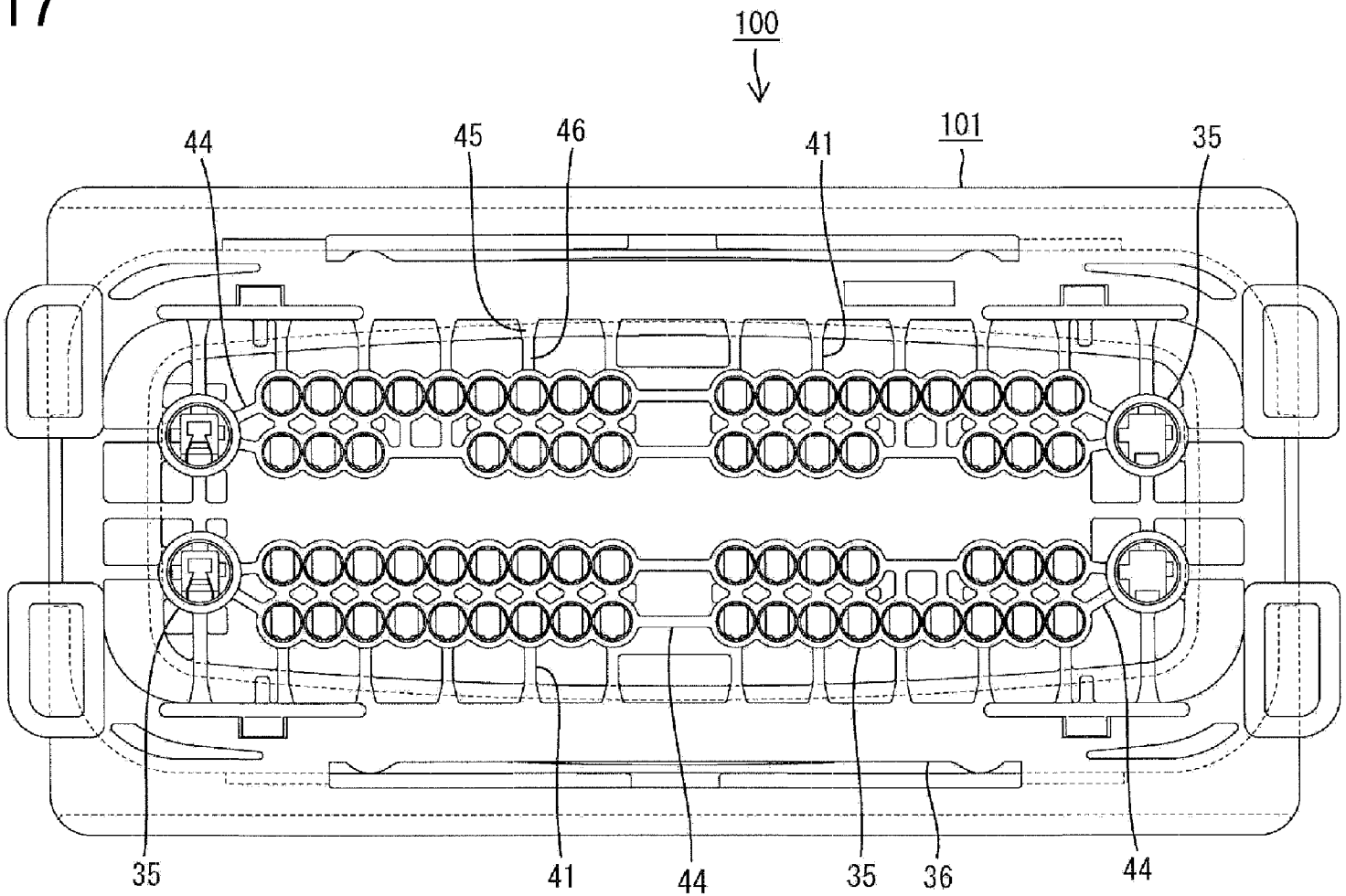
FIG. 17 is a rear view of a female connector housing.

As shown in FIG. 17, the rear surface of a female housing 101 of the mating female connector 100 also has seal towers 35, a surrounding wall 36, outer ribs 41 including tapered sections 45 and straight sections 46 and connecting ribs 44.

The lance housing 50 is assembled into the mount space 28 of the housing main body 20 and retained by the lance housing locks 30 in a properly assembled position. Specifically, as shown in FIGS. 8 to 11, the lance housing 50 faces the front surface of the housing main body 20 at the back of the mount space 28. The lance housing 50 has a substantially plate-like lance housing main body 52 with terminal insertion holes 51 that communicate with the respective small cavities 29 as the lance housing 50 is assembled. Tubular cavity towers 53 are arranged at positions corresponding to the terminal insertion holes 51 and project forward from the front surface of the lance housing main body 52. Locking lances 27 are located in the respective cavity towers 53 and project forward from the front surface of the lance housing main body 52. Substantially plate-like lance housing interlocking portions 54 project forward from the opposite upper and lower ends of the lance housing main body 52. Locking claws 55 project out from the lance housing interlocking portions 54 and engage resiliently with the lance housing locks 30 of the housing main body 20 to retain the lance housing 50 in the mount space 28.

Each cavity tower portion 53 has a horizontal plate-shaped upper wall 56 that extends in forward and backward directions FBD, opposite side walls 57 hang vertically down from opposite lateral edges of the upper wall 56 and a front wall 58 connects the front ends of the upper wall 56 and the opposite side walls 57 to close the front. A terminal insertion hole 51 is defined by the inner space between the upper wall 56, the side walls 57 and front wall 58 and is substantially continuous with the lance housing main body 52. The male terminal fitting 90 is insertable into the terminal insertion hole 51 from the side of the cavity 21. The front openings of the terminal insertion holes 51 forming the front ends of the cavity towers 53 are aligned substantially at the same positions as the front openings of the large cavities 26 with respect to forward and backward directions FBD. Posture maintaining ribs 59 extend in forward and backward directions FBD on the inner surfaces of the opposite side walls 57 and prevent the male terminal fitting 90 from inclining forward. The side surfaces of the male terminal fitting 90 can slide on the posture maintaining ribs 59 to hold the male terminal fitting 90 in a desired horizontal posture. A tab insertion hole 60 penetrates the front wall 58 in forward and backward directions FBD for permitting insertion of the tab 91 of the male terminal fitting 90. The inner surface of the tab insertion hole 60 defines a conical guiding surface 60 that widens toward the rear surface of the front wall 58.

Each locking lance 27 face the inner surface of the upper wall 56 of the cavity tower 53 and projects from a base end thereof connected with the lance housing main body 52 substantially toward the terminal insertion hole 51. The locking lance 27 is vertically resiliently deformable in a direction intersecting an insertion direction of the terminal fitting 90 into the cavity 21 with the base end connected with the lance housing main body 52 as a support. A deformation space 63 for the locking lance 27 is formed between the locking lance 27 and the lower and adjacent cavity tower 53 or a plate-like lower stay portion 62 that projects forward from the bottom end of the front surface of the housing main body 20. A locking projection 64 is provided near the leading end of the upper surface of the locking lance 27 projecting into the terminal insertion hole 51. The width of the locking lance 27 is substantially equal to the width of the upper wall 56 of the cavity tower 53, so that the locking lance 27 is small, but sufficiently strong. An engaging rib 65 extends in forward and backward directions FBD in a widthwise intermediate position of the lower surface of the locking lance 27 to further increase the strength of the locking lance 27.

A first error connection preventing rib 66 projects from one lateral edge of the lance housing main body 52 for direction discrimination of the lance housing 50. This first error connection preventing rib 66 fits into an error connection preventing rib receiving recess 19 formed in the front surface of the housing main body 20. Thus, the lance housing 50 is prevented from being assembled erroneously with the housing main body 20.

Three openings are formed one above another in a widthwise intermediate part of the lance housing main body 52, and the cavity towers 53 and the locking lances 27 are arranged at the opposite left and right sides of these openings. The openings penetrate a reinforcing rib 67 projecting from the front surface of the lance housing main body 52 in forward and backward directions FBD. The upper and lower openings define auxiliary receiving holes 68 for receiving auxiliary projections 64 of the retainer 70, and the middle opening defines a receiving hole 69 for receiving a projection 75 of the retainer 70. The auxiliary receiving holes 68 are vertically long and substantially rectangular. The receiving hole 69 is a substantially cross-shaped opening corresponding to the insertion hole 31 and aligns with the insertion hole 31 as the lance housing main body 52 is assembled with the housing main body.

The retainer 70 is arranged to face the front surface of the lance housing 50 and includes a substantially plate-like retainer main body 72 formed with fitting windows 71 for receiving the cavity towers 53 and the locking lances 27 when the retainer 70 is assembled with the lance housing 50, as shown in FIGS. 12 to 16. The retainer 70 also includes connection ribs 73 that project forward from the front surface of the retainer main body 72, auxiliary projections 74 and a projection 75 that project back from a widthwise intermediate part of the rear surface of the retainer main body 72, and slide plates 76 that are slidably fittable to the inner surfaces of the lance housing locks 54 and the side surfaces of the cavity towers 53 as the retainer 70 is assembled.

Upon assembling the retainer 70, the slide plates 76 are slidable while substantially being held between the inner surfaces of the mount space 28 of the housing main body 20 and the outer surfaces of the lance housing 50. A second error connection preventing rib 77 projects from a lateral edge of the slide plate 76 for direction discrimination of the retainer 70. This second error connection preventing rib 77 fits into the error connection preventing rib recess 19 of the housing main body 20 while being united with the first error connection preventing rib 66. Thus, the retainer 70 is prevented from being assembled erroneously with the housing main body 20.

The cavity towers 53 fit individually into the fitting windows 71, which are defined by a lattice 88 that projects from the rear surface of the retainer main body 72. The front surfaces of the cavity towers 53 are arranged at the same positions as the front surfaces of the fitting windows 71 with respect to forward and backward directions FBD in a properly assembled state with the lance housing 50. Thus, front surfaces of the terminal insertion holes 51 are at the front end of the retainer main body 72. A terminal lock 78 is provided at a position of a lateral edge of the fitting window 71 corresponding to each locking lance 27 of the lance housing 50 and enters the deformation space 63 for the locking lance 27 in the properly assembled state. A rearwardly-open engaging groove 79 is formed in a widthwise intermediate part of each terminal lock 78 to permit the engaging rib 65 of the locking lance 27 to escape. The engaging rib 65 fits into the engaging groove 79 to prevent widthwise loose movements of the locking lance 27.

The connection ribs 73 include a first connection rib 80 located in a widthwise intermediate part of the front surface of the retainer main body 72 and having a vertically long cross-shaped cross section, a second connection rib 81 located on the right side of the front surface of the retainer main body 72 and having an inverted T-shaped cross section with a long horizontal section, and a third connection rib 82 located on the left side of the front surface of the retainer main body 72 and having a wide cross-shaped cross section. The first, second and third connection ribs 80, 81 and 82 are arranged in dead spaces where no fitting windows 71 are provided, and are shaped in conformity with the shapes of the dead spaces. The connection ribs 73 can enter connection rib receiving portions (not shown) formed in the female connector 100 to guide a connecting operation as the connector is connected with the mating female connector 100, and contact the front surface of the female connector 100 to prevent an erroneous connection of the two connectors 10, 100 if the female connector 100 is not in a proper posture.

The auxiliary projections 74 have projecting distances so that their leading ends reach the rear ends of the auxiliary receiving holes 68 of the lance housing 50 upon insertion into the auxiliary receiving holes 68. However, the projection 75 has a projecting distance so that its leading end is inserted into the insertion hole 31 of the housing main body 20 through the receiving hole 69 of the lance housing 50 upon being inserted into the receiving hole 69. The auxiliary projections 74 have a rectangular frame-shaped cross section, and hollow portions 83 with open rear ends are formed inside them.

The projection 75 has a substantially cross-shaped cross section conforming to the receiving hole 69 and the insertion hole 31 and is in a back-to-back relationship with the first connection rib 80 with the retainer main body 72 located therebetween. Specifically, the projection 75 is comprised of a long narrow vertical rib 84 that extends back with a projecting distance that is larger (preferably several times as large) as projecting distances of the auxiliary projections 74 and the slide plates 76, and a short horizontal rib 85. The vertical rib 84 and the horizontal rib 85 are connected with each other at substantially right angles at a position slightly above the vertical center. A slanted surface 86 is formed over the entire periphery of the leading end surface of the projection 75 for smooth insertion into the receiving hole 69 and the insertion hole 31.

Molten resin is injected through the unillustrated gates upon molding the housing main body 20. The molten resin then flows from the surrounding wall 36 toward the seal towers 35 via the outer ribs 41. The tapered sections 45 at the outer ribs 41 guide the flowing molten resin smoothly toward the seal towers 35. The molten resin also flows smoothly toward the seal towers 35 via the main rib 42 and the inner ribs 43 as another route. Thus, a molding failure occurrence rate can be suppressed by the presence of the ribs 37 even if the seal towers 35 are thin.

The lance housing 50 is fit into the mount space 28 of the housing main body 20 and is retained in the housing main body 20 by the resilient engagement of the lance housing locks 30 and the lance housing interlocking portions 54. The first error connection preventing rib 66 of the lance housing 50 then enters the error connection preventing rib receiving portion 19 and the receiving hole 69 of the lance housing 50 is aligned with the insertion hole 31. In this state, the male terminal fittings 90 are inserted into the cavities 21 from behind. The large male terminal fittings 90 then are locked by the locking lances 27 of the large cavities 26 and the tabs 91 at the leading ends thereof project into the receptacle 23. The small male terminal fittings 90 are arranged from the cavities 21 to the terminal insertion holes 51 and retained by the locking lances 27 of the terminal insertion holes 51, and the tabs 91 at the leading ends thereof project into the receptacle 23 through the tab insertion holes 60. As the male terminal fittings 90 are mounted, the plugs 96 mounted on the ends of the wires 95 are accommodated into the seal towers 35. Inner circumferential surfaces of the sealing plugs 96 closely contact the outer circumferential surfaces of the wires 95 while outer circumferential surfaces of the sealing plugs 96 contact the inner circumferential surfaces of the seal towers 35.

Figure 5:
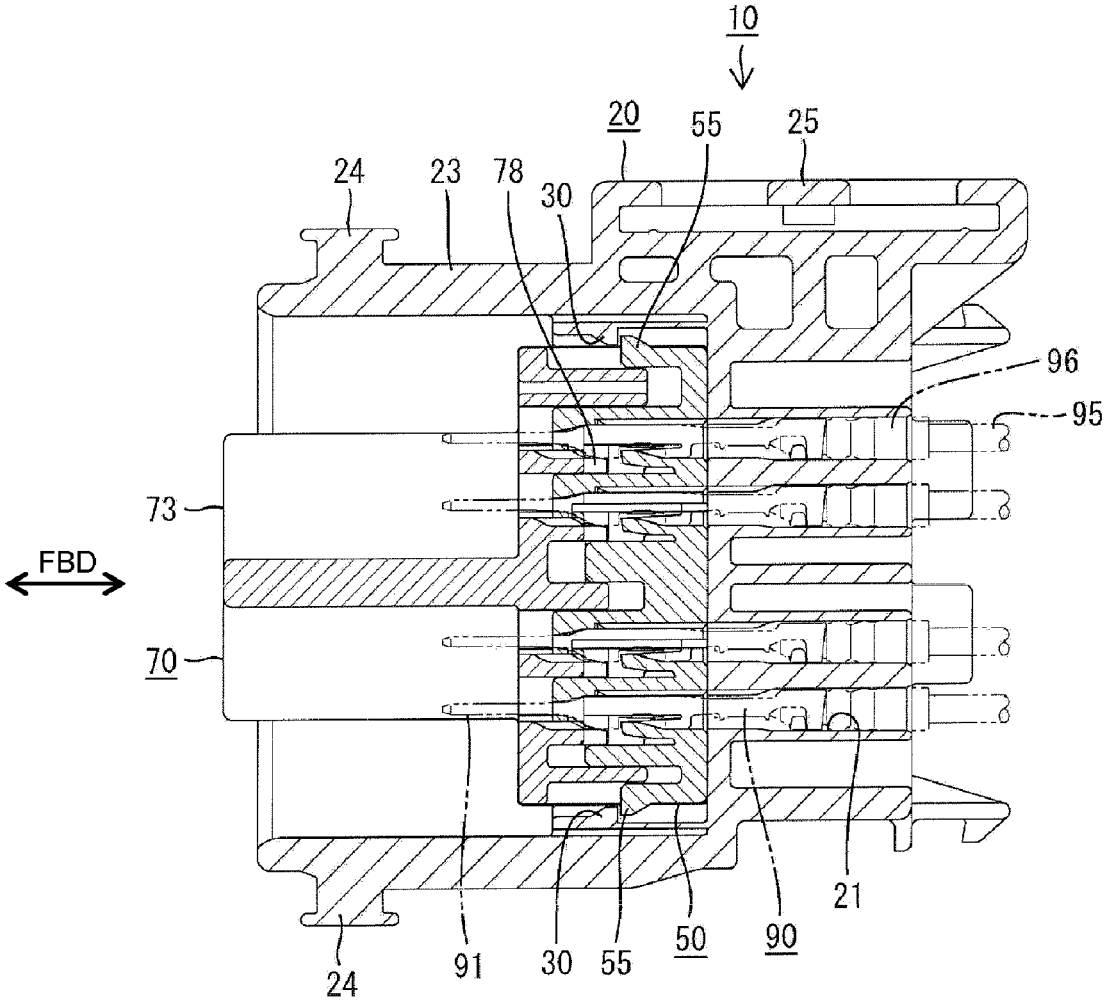
FIG. 5 is a section along A-A of FIG. 1

The retainer 70 is arranged on the front surface of the lance housing 50 and is held in a partly locked state while the male terminal fittings 90 are being mounted. In this partly locked state, the terminal locks 78 of the retainer 70 are arranged at front positions so as not to enter the deformation spaces 63 for the locking lances 27, as shown in FIG. 5. Thus, the locking lances 27 can deform so that the male terminal fittings 90 can be inserted.

The retainer main body 72 covers the front surface of the lance housing main body 52 when the retainer 70 is mounted. Additionally, the cavity towers 53 are fit into the fitting windows 71 of the retainer main body 72 and the projection 75 aligns with and fits into the receiving hole 69, as shown in FIG. 4. The cross shapes of the projection 75 and the receiving hole 69 prevent rotational movements of the retainer 70 about an axis relative to the lance housing 50 in the process of mounting the retainer 70.

Figure 5A:
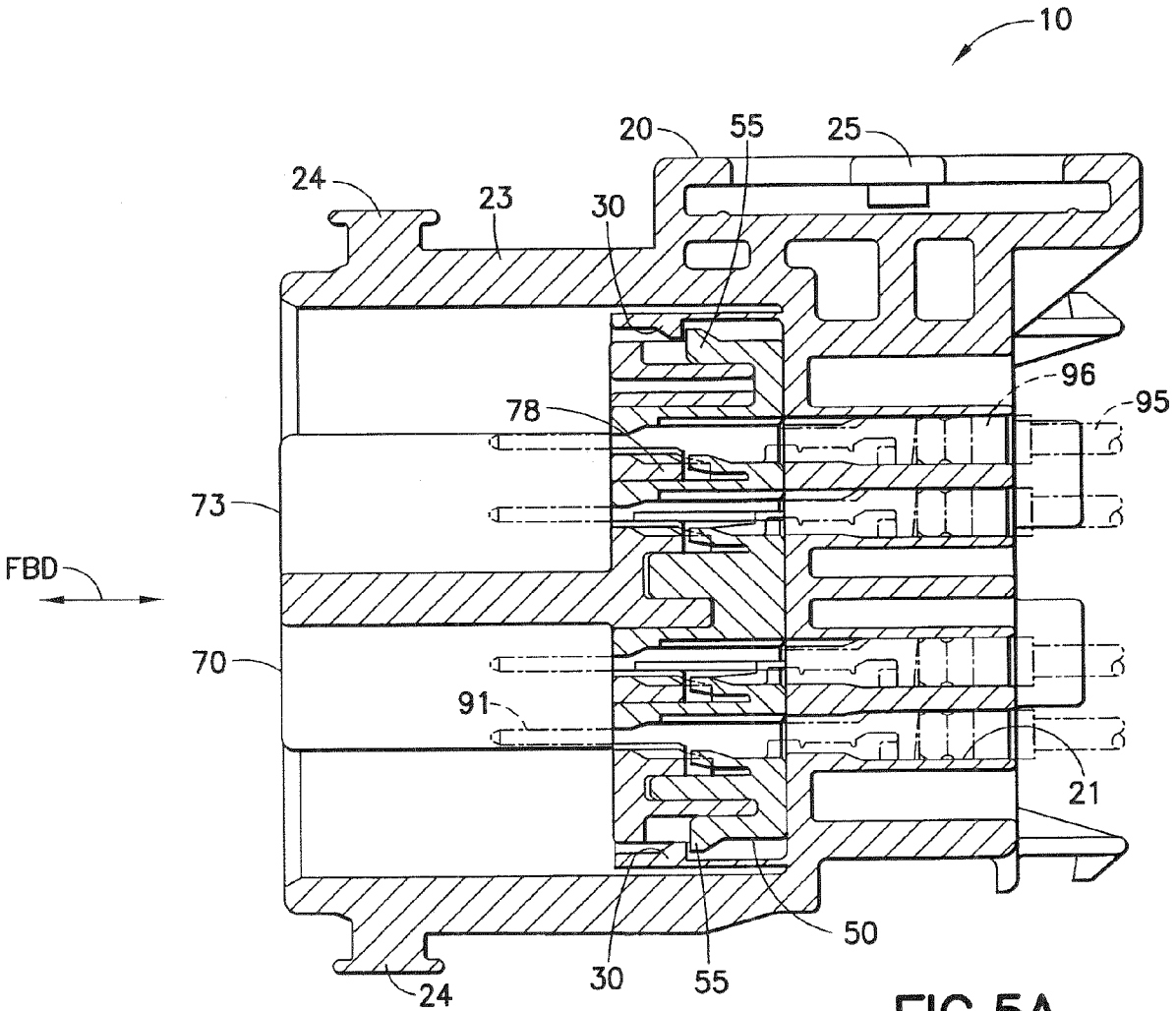
FIG 5A is a cross-section similar to FIG. 5, but showing the retainer in a fully locked state.
Figure 6:
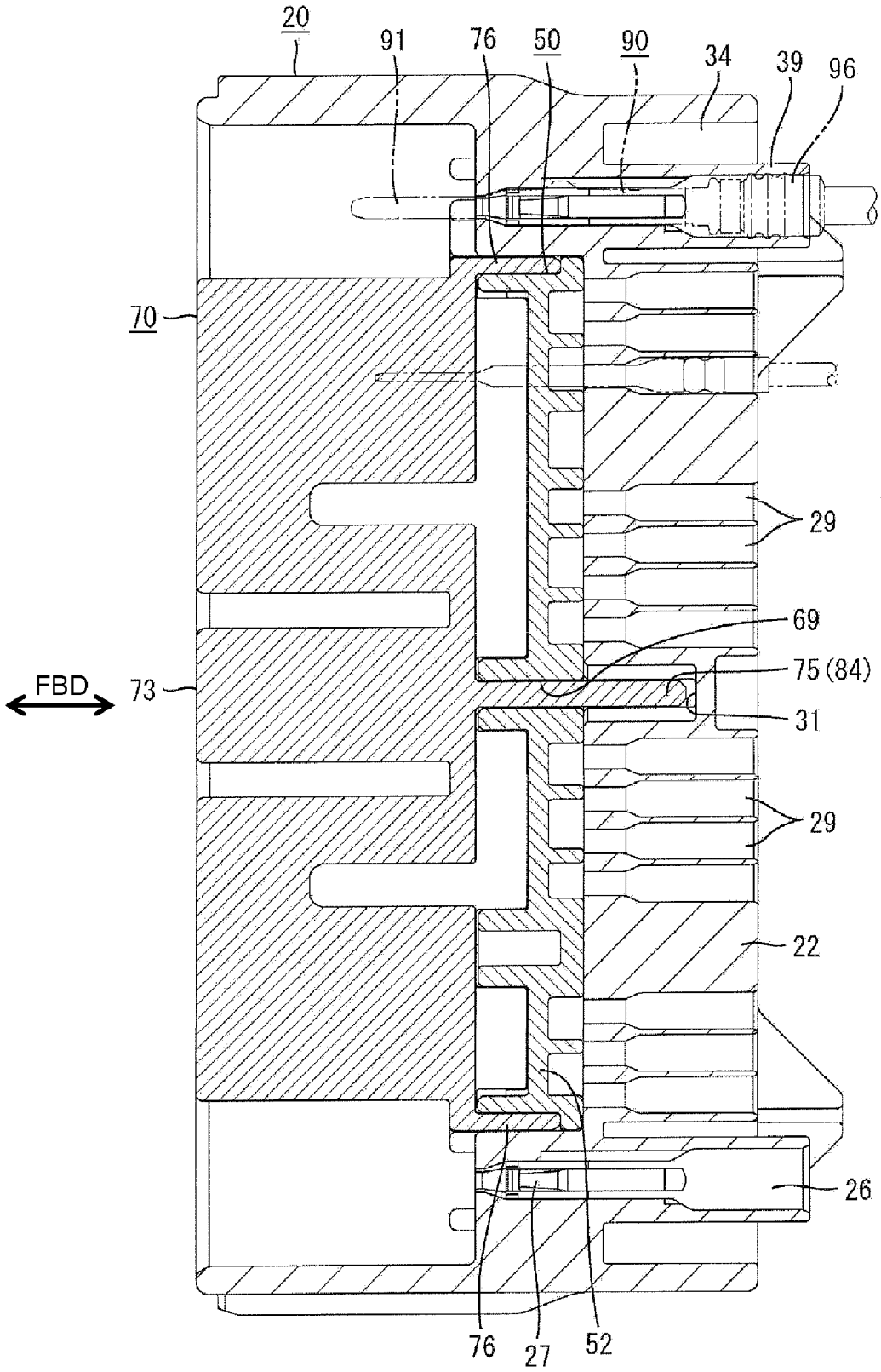
FIG. 6 is a horizontal section when the retainer is properly assembled with the housing main body and the lance housing.

Subsequently, as shown in FIGS. 5A and 6, the retainer 70 is pushed deeply into the receptacle 23 to reach a properly assembled state. Then, the terminal locks 78 enter the deformation spaces 63 for the locking lances 27 to restrict resilient deformations of the locking lances 27. Thus, the male terminal fittings 90 are locked doubly locked. Further, the second error connection preventing rib 77 of the retainer 70 is fit to a proper depth into the error connection preventing rib receiving portion 19 and the projection 75 is inserted to a proper depth into the insertion hole 31 from the receiving hole 69. As a result, the retainer 70 is positioned with respect to the lance housing 50 and the housing main body 20. In this case, the retainer 70 is pushed smoothly by pushing the leading ends of the connection ribs 73 projecting from the front surface of the receptacle 23 in the partly locked state. Thereafter, the female housing 101 of the mating female connector 100 is fitted into the receptacle 23 while being guided by the connection ribs 73 to establish an electrical connection between the two connectors.

The projection 75 is provided on the retainer 70 and the receiving hole 69 is formed in the lance housing 50. Thus, the lance housing 50 is positioned with respect to the retainer 70 by inserting the projection 75 into the receiving hole 69. Accordingly, a mutual positional relationship of the lance housing 50 and the retainer 70 is determined precisely, and displacements of the terminal locks 78 from positions for insertion into the deformation spaces 63 for the locking lances 27 can be prevented as illustrated in FIG. 5A. As a result, a primary function of the retainer 70 is exhibited correctly.

The projection 75 penetrates through the lance housing 50 and the leading end thereof is fit into the insertion hole 31. Thus, an area of engagement of the projection 75 with the lance housing 50 and the housing main body 20 is increased to suppress shaking movements of the retainer 70. In this way, the retainer 70, the lance housing 50 and the housing main body 20 are positioned at proper positions.

The leading end of the projection 75 is fit in the insertion hole 31 even when the retainer 70 is in the partly locked state Thus, the retainer 70 constantly is held stably without shaking. When the retainer 70 moves from the partly locked state to the properly assembled state, the projection 75 can be inserted smoothly into the insertion hole 31 without getting caught by the edge of the insertion hole 31.

Only one projection 75 is provided in the central part of the rear surface of the retainer main body 72. Thus, a reduction in the effective space of the retainer can be suppressed to a minimum necessary level as compared with the case where the projection 75 is provided over a wide range of the rear surface of the retainer main body 72. Further, by forming the projection 75 to have a cross-shaped cross section (or a shape not being rotationally symmetric thus defining a specified orientation around the longitudinal axis), sufficient strength can be ensured, shaking movements in the height and width directions can be reliably suppressed, and pivotal movements of the lance housing 50 about the axis of the projection 75 can be hindered.

The outer ribs 41 preferably are thicker at the connected parts with the surrounding wall portion 36. Thus, resin can flow more easily toward the seal towers 35 to make a molding failure less likely. On the other hand, the outer ribs 41 are thinner at the connections with the seal towers 35. Thus, sinks will not form in the seal tower portions 35.

the outer ribs 41 are formed over the entire lengths of the surrounding wall 36 and the smaller seal towers 38 in forward and backward directions. Thus, resin flow is more improved.

The outer ribs 41 include the tapered sections 45 narrowed toward the seal towers 35 from the surrounding wall 36 to form guides for the resin toward the seal towers 35. Thus, resin flow is improved even more. The outer ribs 41 include the straight sections 46 extending substantially straight from the leading ends of the tapered sections 45 to the seal towers 35. Thus, sinks are not formed in the seal towers 35 during molding.

The seal towers 35 are thinner than the minimum dimension of the outer ribs 41. Thus, sinks in the seal tower portions 35 can be more reliably avoided.

The inner ribs 43 extend between the outer surfaces of the main rib 42 dividing the respective seal towers 35 into at least upper and lower groups and the outer surfaces of the seal towers 35. Thus, the lengths of the inner ribs 43 can be shorter to further improve resin flow as compared with the case where the inner ribs 43 directly bridge between the respective seal tower portions divided into the two upper and lower groups.

Adjacent seal towers 35 are connected to each other by the connecting ribs 44. Thus, the adjacent seal towers 35 can be held with sufficient strength. On the other hand, the connecting ribs 44 are located on the substantially straight lines connecting the centers of the adjacent seal tower portions 35. Thus, connection margins between the connecting ribs 44 and the seal towers 35 are not larger than necessary. As a result the formation of sinks in the seal towers 35 can be more reliably avoided to allow a retainer to exhibit its original function in the case of separately providing a housing main body and a lance housing.

The invention is not limited to the above described and illustrated embodiment. For example, the following embodiments are also embraced by the technical scope of the present invention as defined by the claims.

Plural projections may project at arbitrary positions of the retainer.

It is sufficient for the projection to be so shaped to position the lance housing with respect to the retainer, and the projection may have, for example, a polygonal cross section.

The projection may be fit only into the receiving hole of the lance housing and may not be engaged with the housing main body.

The projection may include a part extending in the width direction and a part extending in the height direction (e.g. cross shape, T shape, L shape or shape formed by both parts not intersecting with each other) and may be provided at a position back to back with the connection rib with the retainer main body therebetween to utilized space can effectively.

The lance housing and the housing main body may be provided in a female connector accommodating female terminal fittings.

The thickness of the seal towers may be equal to the minimum dimension of the outer ribs.

It is sufficient for the connected parts of the outer ribs with the surrounding wall to be thicker than the connected parts thereof with the seal towers and the outer ribs may not necessarily include the tapered sections.

It is sufficient for the connected parts of the outer ribs with the seal towers to be thinner than the connected parts thereof with the surrounding wall portion and the outer ribs may not necessarily include the straight sections.

The surrounding wall portion and the seal towers may be intermittently continuous by being formed with cuts in some parts.

One main rib divides the seal towers into upper and lower groups in the height direction in the above embodiment. However, the main rib can have other shapes. For example, plural main ribs may divide the plurality of seal towers into a plurality of groups in the height direction. Alternatively, one or more main ribs may divide the seal towers into two or more groups in the width direction. Further, the seal towers may be divided into four groups by one main rib extending in the height direction and one main rib extending in the width direction. Furthermore, the main rib may extend obliquely to the height direction and the width direction.

What is claimed is:

1. A connector, comprising:

a housing main body formed with one or more cavities for receiving one or more terminal fittings;

at least one lance housing provided separately from the housing main body and formed with one or more terminal insertion holes that communicate with the respective cavities when the lance housing is arranged on the housing main body, the lance housing having resiliently deformable locking lances corresponding to the terminal insertion holes and configured to retain the terminal fittings inserted in the terminal insertion holes and a deformation spaces (63) adjacent each locking lance (27) and a deformation space adjacent each locking lance; and a retainer provided separately from the lance housing and having one or more terminal locks that can enter one or more deformation spaces for the respective locking lances engaged with the terminal fittings when the retainer is arranged on the lance housing.

2. The connector of claim 1 wherein at least one projection projects from the retainer, and at least one receiving hole formed in the lance housing for receiving the projection to position the lance housing and the retainer with respect to each other by at least partly inserting the projection into the respective receiving hole.

3. The connector of claim 2, wherein the retainer is mounted on a front surface of the lance housing, an insertion hole being formed in the front surface of the housing main body substantially in conformity with the projection, and the projection penetrating through the lance housing (50) and into the insertion hole as the retainer is assembled.

4. The connector of claim 3, wherein the retainer is displaceable to a partly locked state where resilient deformations of the locking lances are permitted to permit the insertion and withdrawal of the terminal fittings into and from the cavities and to a fully locked state, attained by moving the retainer toward the lance housing, where resilient deformations of the locking lances are restricted and the terminal fittings inserted in the cavities are retained by the terminal locking lances.

5. The connector of claim 4, wherein the leading end of the projection is fitted in the insertion hole when the retainer is both in the partly locked state and in the fully locked state.

6. The connector of claim 2, wherein the projection includes a first part extending in a first direction and a second part extending in a second direction intersecting the first direction, at least one rib provided at a position back to back with the projection with a main body of the retainer located therebetween.

7. The connector of claim 2, wherein the projection has a cross-shaped cross section and is provided in a central part of the rear surface of the retainer.

* * * * *